US011781444B1

(12) United States Patent
Morton et al.

(10) Patent No.: US 11,781,444 B1
(45) Date of Patent: Oct. 10, 2023

(54) ADAPTIVE ORIFICE ASSEMBLY FOR CONTROLLING AIRFLOW IN A GAS TURBINE ENGINE

(71) Applicant: General Electric Company, Schenectady, NY (US)

(72) Inventors: William Morton, Niskayuna, NY (US); Constantinos Minas, Slingerlands, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/831,500

(22) Filed: Jun. 3, 2022

(51) Int. Cl.
*F01D 17/14* (2006.01)

(52) U.S. Cl.
CPC ..... *F01D 17/141* (2013.01); *F05D 2260/207* (2013.01); *F05D 2260/60* (2013.01); *F05D 2300/505* (2013.01)

(58) Field of Classification Search
CPC .. F01D 17/14; F01D 17/141; F16K 1731/002; F16K 99/0036
See application file for complete search history.

(56) References Cited

U.S. PATENT DOCUMENTS 4,253,611 A * 3/1981 Hart ..... F02M 19/03 239/602
8,757,508 B2 6/2014 Haasz et al.
9,261,022 B2 * 2/2016 Saha ..... F01D 25/12
9,267,382 B2 2/2016 Szwedowicz et al.
9,617,859 B2 4/2017 Morgan et al.
10,794,289 B2 10/2020 Groves, II et al.
10,961,864 B2 3/2021 Miranda et al.
2014/0157791 A1 * 6/2014 Saha ..... F01D 17/141 60/785

FOREIGN PATENT DOCUMENTS

CN 112282858 A 1/2021
GB 2022710 A 12/1979
KR 101595996 A 2/2016

* cited by examiner

*Primary Examiner* — Brian O Peters
(74) *Attorney, Agent, or Firm* — Dority & Manning, P.A.

(57) ABSTRACT

An orifice assembly includes a first member defining an orifice having a first dimension in a compressed state and a thermally-sensitive material arranged adjacent to the first member. The thermally-sensitive material has a rigid, first state that applies force to the first member so as to maintain the first dimension of the orifice in the compressed state and a flexible, second state configured to release the force applied to the first member. As such, when subjected to temperatures above a predetermined temperature threshold, the thermally-sensitive material changes from the rigid, first state to the flexible, second state to allow the first dimension of the first member in the compressed state to passively expand to a decompressed, second dimension, the second dimension being larger than the first dimension.

18 Claims, 5 Drawing Sheets

ADAPTIVE ORIFICE ASSEMBLY FOR CONTROLLING AIRFLOW IN A GAS TURBINE ENGINE

FIELD

The present disclosure relates to a gas turbine engine and, more particularly, to assemblies for controlling airflow in gas turbine engines.

BACKGROUND

Gas turbine engines generally include a turbine section downstream of a combustion section that is rotatable with a compressor section to rotate and operate the gas turbine engine to generate power, such as propulsive thrust. Typically, the turbine section defines a high pressure turbine in serial flow arrangement with an intermediate pressure turbine and/or low pressure turbine. The high pressure turbine includes an inlet or nozzle guide vane between the combustion section and the high pressure turbine rotor. Conventionally, combustion gases exiting the combustion section define a relatively low velocity compared to a velocity (e.g., along a circumferential or tangential direction) of the first rotating stage of the turbine, generally defined as the high pressure turbine rotor. Thus, conventionally, the nozzle guide vane serves to accelerate a flow of combustion gases exiting the combustion section to more closely match or exceed the high pressure turbine rotor speed along a tangential or circumferential direction. Such acceleration of flow using a nozzle guide vane to match or exceed high pressure turbine rotor speed is known to improve general engine operability and performance.

Thereafter, conventional turbine sections generally include successive rows or stages of stationary and rotating airfoils, or vanes and blades, respectively. Such configurations generally condition a flow of the combustion gases entering and exiting each stage of vanes and blades. However, conventional turbine sections, and especially stationary airfoils (i.e., vanes and nozzle guide vanes) require considerable quantities and masses of cooling air to mitigate damage due to hot combustion gases.

Thus, conventional gas turbine engines include various orifices or openings to control airflow therethrough. Conventional orifice(s) are equipped with valves that open and close to accommodate changing conditions of the gas turbine engine or are manually replaced with orifices having different, but fixed dimensions to accommodate the changing conditions. However, such orifices have a fixed size that is determined at the design stage of the gas turbine engine for worst-case conditions (e.g., deterioration, hot days, worst pattern factors, etc.). As such, too much airflow may flow through the fixed orifices during early portions of the operating life of the gas turbine engine, thereby decreasing turbine efficiency. To correct for this issue, such orifices have to be disassembled and/or physically modified to increase the dimensions thereof so as to allow for an increased airflow therethrough.

BRIEF DESCRIPTION OF THE DRAWINGS

A full and enabling disclosure, including the best mode thereof, directed to one of ordinary skill in the art, is set forth in the specification, which makes reference to the appended figures, in which.

Figure 1:
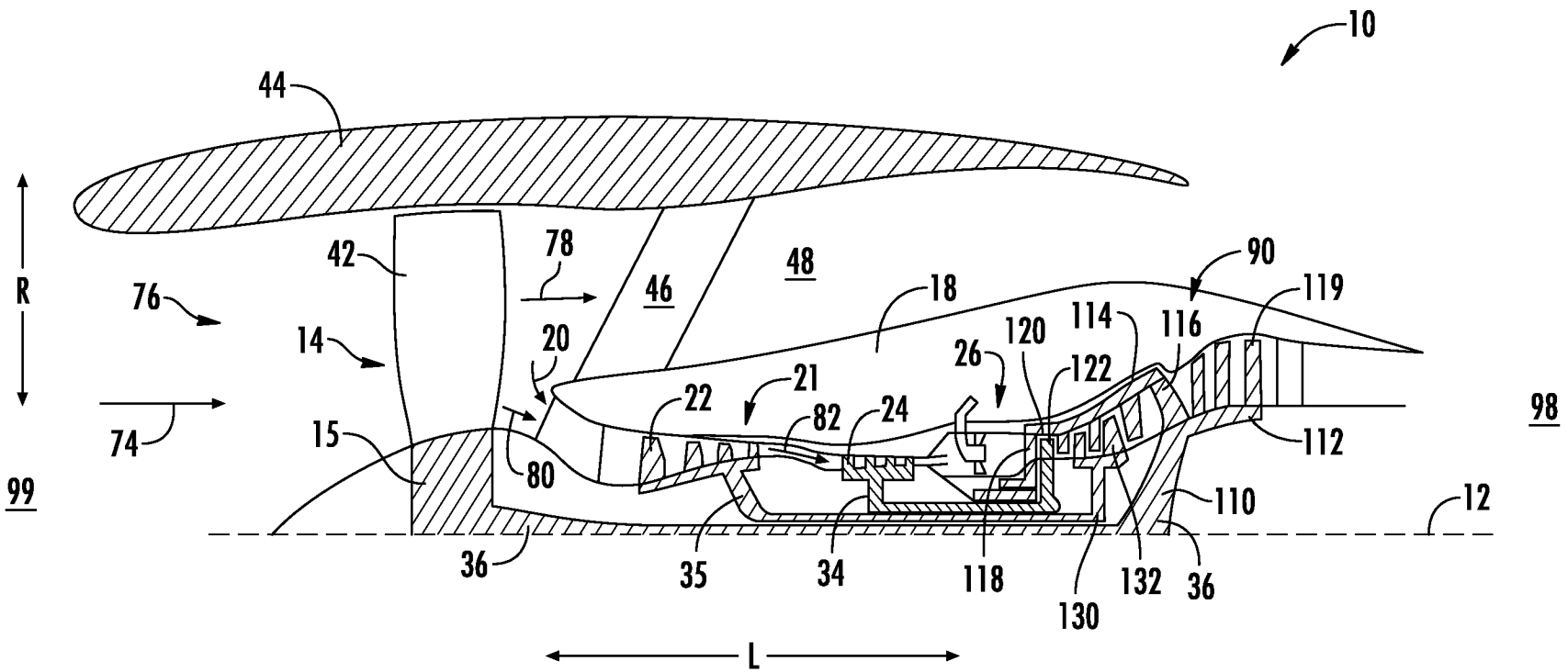
FIG. 1 is a schematic cross sectional view of an exemplary gas turbine engine incorporating an exemplary embodiment of a turbine section according to an aspect of the present disclosure.

Repeat use of reference characters in the present specification and drawings is intended to represent the same or analogous features or elements of the present disclosure.

DETAILED DESCRIPTION

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The singular forms "a", "an", and "the" include plural references unless the context clearly dictates otherwise.

The term "at least one of" in the context of, e.g., "at least one of A, B, and C" refers to only A, only B, only C, or any combination of A, B, and C.

The term "turbomachine" refers to a machine including one or more compressors, a heat generating section (e.g., a combustion section), and one or more turbines that together generate a torque output.

The term "gas turbine engine" refers to an engine having a turbomachine as all or a portion of its power source. Example gas turbine engines include turbofan engines, turboprop engines, turbojet engines, turboshaft engines, etc., as well as hybrid-electric versions of one or more of these engines.

The term "combustion section" refers to any heat addition system for a turbomachine. For example, the term combustion section may refer to a section including one or more of a deflagrative combustion assembly, a rotating detonation combustion assembly, a pulse detonation combustion assembly, or other appropriate heat addition assembly. In certain example embodiments, the combustion section may include an annular combustor, a can combustor, a cannular combustor, a trapped vortex combustor (TVC), or other appropriate combustion system, or combinations thereof.

The terms "low" and "high", or their respective comparative degrees (e.g., -er, where applicable), when used with a compressor, a turbine, a shaft, or spool components, etc. each refer to relative speeds within an engine unless otherwise specified. For example, a "low turbine" or "low speed turbine" defines a component configured to operate at a rotational speed, such as a maximum allowable rotational speed, lower than a "high turbine" or "high speed turbine" of the engine.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, the terms "axial" and "axially" refer to directions and orientations that extend substantially parallel to a centerline of the gas turbine engine. Moreover, the terms "radial" and "radially" refer to directions and orientations that extend substantially perpendicular to the centerline of the gas turbine engine. In addition, as used herein, the terms "circumferential" and "circumferentially" refer to directions and orientations that extend arcuately about the centerline of the gas turbine engine.

The terms "coupled", "fixed", "attached to", and the like refer to both direct coupling, fixing, or attaching, as well as indirect coupling, fixing, or attaching through one or more intermediate components or features, unless otherwise specified herein.

As used herein, the terms "first", "second", "third" and so on may be used interchangeably to distinguish one component from another and are not intended to signify location or importance of the individual components.

The term "adjacent" as used herein with reference to two walls and/or surfaces refers to the two walls and/or surfaces contacting one another, or the two walls and/or surfaces being separated only by one or more nonstructural layers and the two walls and/or surfaces and the one or more nonstructural layers being in a serial contact relationship (i.e., a first wall/surface contacting the one or more nonstructural layers, and the one or more nonstructural layers contacting the a second wall/surface).

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin. These approximating margins may apply to a single value, either or both endpoints defining numerical ranges, and/or the margin for ranges between endpoints.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Conventional gas turbine engines include various orifices or openings to control airflow therethrough. For example, various gas turbine engine nozzles (or any other suitable airflow passageway) may include an orifice for controlling airflow in the engine. Conventional orifice(s) may be equipped with valves that open and close to accommodate changing conditions of the gas turbine engine or may be manually replaced with orifices having different, but fixed dimensions to accommodate the changing conditions. However, such orifices have a fixed size this is determined at the design stage of the gas turbine engine for worst-case conditions (e.g., deterioration, hot days, worst pattern factors, etc.). As such, too much airflow may flow through the fixed orifices during early portions of the operating life of the gas turbine engine, thereby decreasing turbine efficiency. To correct for this issue, existing orifices have to be disassembled and/or physically modified to increase the dimensions thereof so as to allow for an increased airflow therethrough.

Thus, the present disclosure is generally related to an orifice assembly for passively controlling the size of a metering orifice. In an embodiment, for example, the orifice assembly includes a first, inner member having an orifice defining a first dimension in a compressed state and a second, outer member arranged adjacent to and exterior of the inner member. The orifice assembly also includes a thermally-sensitive material arranged adjacent to and exterior of the outer member. Further, the thermally-sensitive material has a rigid, first state (e.g., such as solid phase-change material (PCM)) that applies force to the inner member so as to maintain the first dimension of the orifice in the compressed state and a flexible, second state (e.g., such as liquified PCM) that releases the force applied to the inner member. Thus, when subjected to temperatures above the predetermined temperature threshold, the thermally-sensitive material changes from the rigid, first state to the flexible, second state to allow the first dimension of the inner member in the compressed state to passively expand to a decompressed, second dimension. As the second dimension is larger than the first dimension, the increased dimension allows for an increase in airflow to pass through the orifice. For example, in an embodiment, the solid PCM may occupy a gap within the housing that is larger in volume than the solid PCM. At a specific temperature exposure, the solid PCM liquefies and is compressed into the remaining volume of the gap and the inner member expands since the opposing force of the PCM is relieved. Further, in an embodiment, this process may be reversible. In alternative embodiments, this process may be irreversible.

Referring now to the drawings, FIG. 1 is a schematic cross sectional view of an exemplary gas turbine engine 10 (herein referred to as "engine 10"), shown as a high bypass turbofan engine according to an aspect of the present disclosure. Although further described below with reference to a turbofan engine, the present disclosure is also applicable to turbomachinery in general, including propfan, turbojet, turboprop, and turboshaft gas turbine engines, including marine and industrial turbine engines and auxiliary power units. Still further, although described below as a three-spool gas turbine engine, the present disclosure is also applicable to two-spool gas turbine engines. As shown in FIG. 1, the engine 10 has a longitudinal or axial centerline 12 that extends there through for reference purposes. The engine 10 defines a longitudinal direction L, a radial direction R, and an upstream end 99 and a downstream end 98 along the longitudinal direction L.

In general, the engine 10 may include a substantially tubular outer casing 18 that defines an annular inlet 20. The outer casing 18 encases or at least partially flows, in serial flow arrangement, a compressor section 21, a combustion section 26, and a turbine section 90. Generally, the engine 10 defines, in serial flow arrangement from the upstream end 99 to the downstream end 98, the fan assembly 14, the compressor section 21, the combustion section 26, and the turbine section 90. In the embodiment shown in FIG. 1, the compressor section 21 defines a high pressure (HP) compressor 24 and an intermediate pressure (IP) compressor 22. In other embodiments, the fan assembly 14 may further include or define one or more stages of a plurality of fan blades 42 that are coupled to and extend outwardly in the radial direction R from a fan rotor 15 and/or a low speed shaft 36. In various embodiments, multiple stages of the plurality of fan blades 42 coupled to the low speed shaft 36 may be referred to as a low pressure (LP) compressor.

An annular fan casing or nacelle 44 circumferentially surrounds at least a portion of the fan assembly 14 and/or at least a portion of the outer casing 18. In one embodiment, the nacelle 44 may be supported relative to the outer casing 18 by a plurality of circumferentially-spaced outlet guide vanes or struts 46. At least a portion of the nacelle 44 may extend around an outer portion (in radial direction R) of the outer casing 18 so as to define a bypass airflow passage 48 therebetween.

Figure 2:
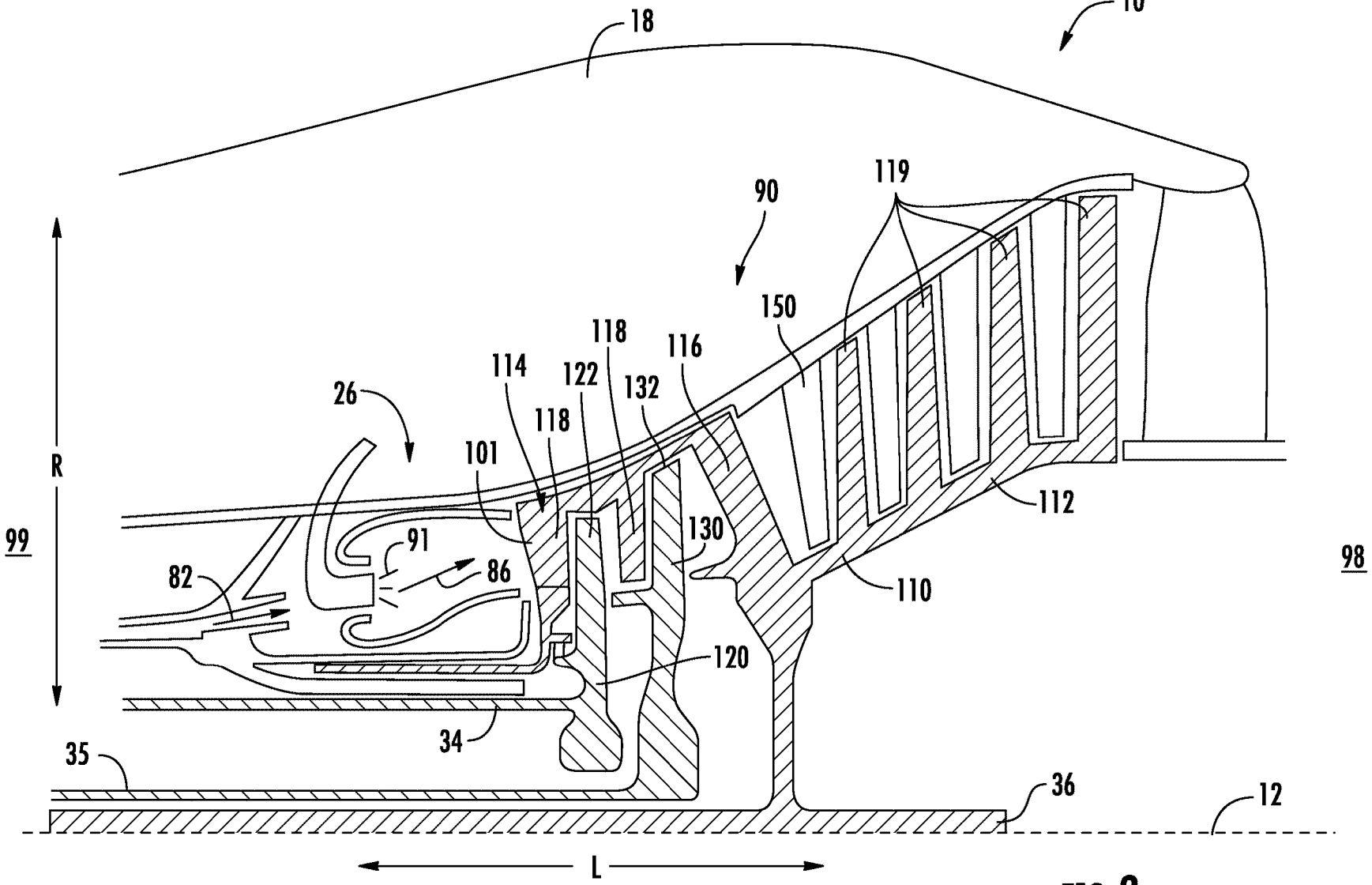
FIG. 2 is a schematic cross sectional view of an embodiment of the combustion section and the turbine section of the gas turbine engine shown in FIG. 1.

Referring now to FIG. 2, an exemplary embodiment of the turbine section 90 of the engine 10 is generally provided. Thus, as generally shown in FIGS. 1 and 2, the turbine section 90 includes a low speed turbine rotor 110 extending along the longitudinal direction L. The low speed turbine rotor 110 includes an inner shroud 112, an outer shroud 114, and at least one connecting airfoil 116 coupling the inner shroud 112 to the outer shroud 114. The outer shroud 114 includes a plurality of outer shroud airfoils 118 extended inward along the radial direction R. In various embodiments, the inner shroud 112 may include a plurality of inner shroud airfoils 119 extended outward along the radial direction R.

The inner shroud 112 and the outer shroud 114 each extend generally along the longitudinal direction L. The inner shroud 112 and/or the outer shroud 114 may each extend at least partially in the radial direction R. In various embodiments, the inner shroud 112 extends from the connecting airfoil 116. In one embodiment, the inner shroud 112 further extends toward the downstream end 98 along the longitudinal direction L. In still various embodiments, the outer shroud 114 extends from the connecting airfoil 116 toward the upstream end 99 along the longitudinal direction L toward the combustion section 26.

Still referring to FIGS. 1 and 2, the turbine section 90 further includes a high speed turbine rotor 120 and an intermediate speed turbine rotor 130 each disposed forward or upstream of the one or more connecting airfoils 116 of the low speed turbine rotor 110. Further, as shown, the high speed turbine rotor 120 includes a plurality of high speed turbine airfoils 122 extending outwardly along the radial direction R. The intermediate speed turbine rotor 130 includes a plurality of intermediate speed turbine airfoils 132 extending outwardly along the radial direction R. The pluralities of high speed turbine airfoils 122 and intermediate speed turbine airfoils 132 are each disposed among the pluralities of outer shroud airfoils 118 of the low speed turbine rotor 110 along the longitudinal direction L.

In various embodiments, the low speed turbine rotor 110 defines a plurality of stages of rotating airfoils, such as the plurality of outer shroud airfoils 118 disposed along the longitudinal direction L, the one or more connecting airfoils 116, and/or the plurality of inner shroud airfoils 119 disposed along the longitudinal direction L. In one embodiment, the low speed turbine rotor 110 defines at least one stage forward or upstream of the high speed turbine rotor 120. In another embodiment, the turbine section 90 defines a first stage of airfoils in which the first stage includes the plurality of outer shroud airfoils 118 of the low speed turbine rotor 110 forward or upstream of each stage of the high speed turbine rotor 120.

In still various embodiments, such as shown in FIG. 2, the engine 10 defines, in serial flow arrangement along the longitudinal direction L from the upstream end 99 to the downstream end 98, the plurality of outer shroud airfoils 118 of the low speed turbine rotor 110, the plurality of high speed turbine airfoils 122 of the high speed turbine rotor 120, and the plurality of outer shroud airfoils 118 of the low speed turbine rotor 110. In still various embodiments, additional iterations of interdigitation of the low speed turbine rotor 110 and the high speed turbine rotor 120 may be defined forward or upstream of the connecting airfoils 116.

As another non-limiting example, as shown in FIG. 2, the engine 10 may further define the serial flow arrangement of the plurality of outer shroud airfoils 118, the plurality of high speed turbine airfoils 122, the plurality of outer shroud airfoils 118, the plurality of intermediate speed turbine airfoils 132, the plurality of outer shroud airfoils 118, an additional plurality of intermediate speed turbine airfoils 132, and the connecting airfoils 116. It should be appreciated that although FIG. 2 shows the high speed turbine rotor 120 as defining one stage, the high speed turbine rotor 120 may define generally one or more stages between a first stage 101 of the low speed turbine rotor 110 and the connecting airfoils 116 of the low speed turbine rotor 110, and interdigitated therebetween along the longitudinal direction L. Similarly, it should be appreciated that although FIG. 1 shows the intermediate speed turbine rotor 130 as defining two stages, the intermediate speed turbine rotor 130 may define generally one or more stages between the high speed turbine rotor 120 and the connecting airfoils 116 of the low speed turbine rotor 110.

In various embodiments, the low speed turbine rotor 110 is drivingly connected and rotatable with the low speed shaft 36 extended along the longitudinal direction L and generally concentric about the axial centerline 12. In one embodiment, as shown in FIG. 1, the low speed shaft 36 is connected to the fan assembly 14, of which is driven in rotation by the low speed turbine rotor 110 of the turbine section 90. The low speed shaft 36 is connected to the fan rotor 15 of the fan assembly 14. In various embodiments, the fan assembly 14 may define a plurality of stages of the plurality of fan blades 42.

In various embodiments, the intermediate speed turbine rotor 130 is drivingly connected and rotatable with an intermediate speed shaft 35 extending along the longitudinal direction L and generally concentric about the axial centerline 12. In one embodiment, as shown in FIG. 1, the intermediate speed shaft 35 is connected to the IP compressor 22, of which is driven in rotation by the intermediate speed turbine rotor 130 of the turbine section 90.

The high speed turbine rotor 120 of the turbine section 90 is drivingly connected and rotatable with a high pressure (HP) shaft 34 extending along the longitudinal direction L and generally concentric about the axial centerline 12. The HP shaft 34 is connected to the HP compressor 24, of which is driven in rotation by the high speed turbine rotor 120 of the turbine section 90.

Referring particularly to FIG. 2, the turbine section 90 further includes one or more turbine vanes 150. The turbine vane(s) 150 may define a plurality of stationary airfoils (i.e., vanes) in circumferential arrangement. In one embodiment, the turbine vane(s) 150 is disposed between the pluralities of inner shroud airfoils 119 along the longitudinal direction L. In various embodiments, the turbine vane(s) 150 is disposed downstream of the connecting airfoil 116 of the low speed turbine rotor 110.

During operation of the engine 10, the high speed turbine rotor 120 rotates generally at a higher rotational speed than the intermediate speed turbine rotor 130. The intermediate speed turbine rotor 130 rotates generally at a higher speed than the low speed turbine rotor 110. Accordingly, a volume of air as indicated schematically by arrows 74 (FIG. 1) enters the engine 10 through an associated inlet 76 of the nacelle 44 and/or fan assembly 14. As the air 74 passes across the fan blades 42, a portion of the air as indicated schematically by arrows 78 (FIG. 1) is directed or routed into the bypass airflow passage 48 while another portion of the air as indicated schematically by arrows 80 is directed or through the fan assembly 14. Thus, during operation, the air 80 is progressively compressed as it flows through the compressor section 21 toward the combustion section 26.

The now compressed air, as indicated schematically by arrows 82, flows into the combustion section 26 where a fuel 91 (FIG. 2) is introduced, mixed with at least a portion of the compressed air 82, and ignited to form combustion gases 86. The combustion gases 86 flow into the turbine section 90, causing rotary members of the turbine section 90 to rotate and support operation of respectively coupled rotary members in the compressor section 21 and/or fan assembly 14.

In various embodiments, the low speed turbine rotor 110, and the low speed shaft 36 to which it is attached, rotates in a first direction along the circumferential direction. The high speed turbine rotor 120, and the HP shaft 34 to which it is attached, rotates in a second direction opposite of the first direction along the circumferential direction. In one embodiment, the intermediate speed turbine rotor 130, and the intermediate speed shaft 35 to which it is attached, rotates in the second direction in co-rotation with the high speed turbine rotor 120 and in counter-rotation with the low speed turbine rotor 110.

It should further be understood that the first direction and the second direction as used and described herein are intended to denote directions relative to one another. Therefore, the first direction may refer to a clockwise rotation (viewed from downstream looking upstream) and the second direction may refer to a counter-clockwise rotation (viewed from downstream looking upstream). Alternatively, the first direction may refer to a counter-clockwise rotation (viewed from downstream looking upstream) and the second direction may refer to a clockwise rotation (viewed from downstream looking upstream).

Still further during operation of the engine 10, combustion gases 86 exiting the combustion section 26 define a generally low speed toward the downstream end 98 of the engine 10. A low speed rotation (e.g., along a tangential or circumferential direction) of the first stage 101 of the low speed turbine rotor 110 accelerates a speed of the combustion gases 86, such as in the tangential or circumferential direction, to approximately equal or greater than a speed of the high speed turbine rotor 120.

Figure 3:
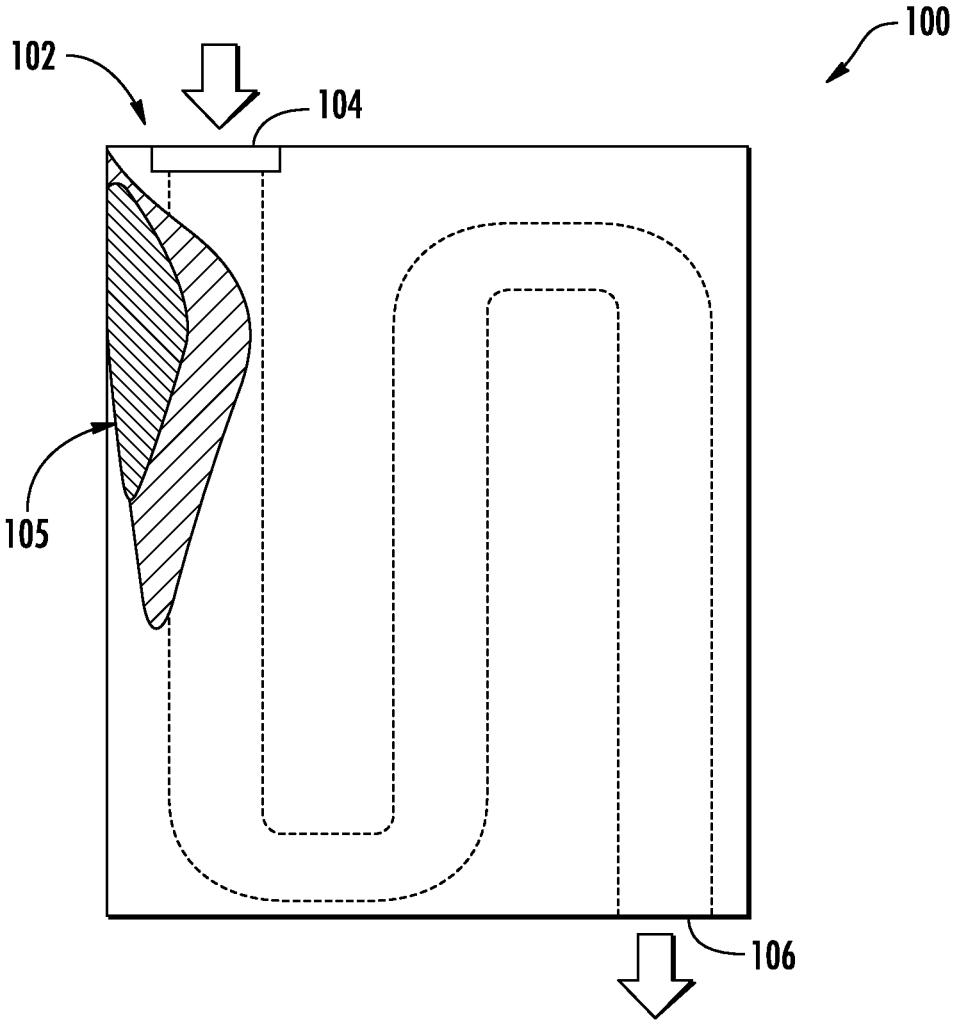
FIG. 3 is a schematic diagram of an example airflow passageway in a gas turbine engine having an orifice assembly for controlling airflow of an inlet thereof arranged at the inlet according to the present disclosure.
Figure 4:
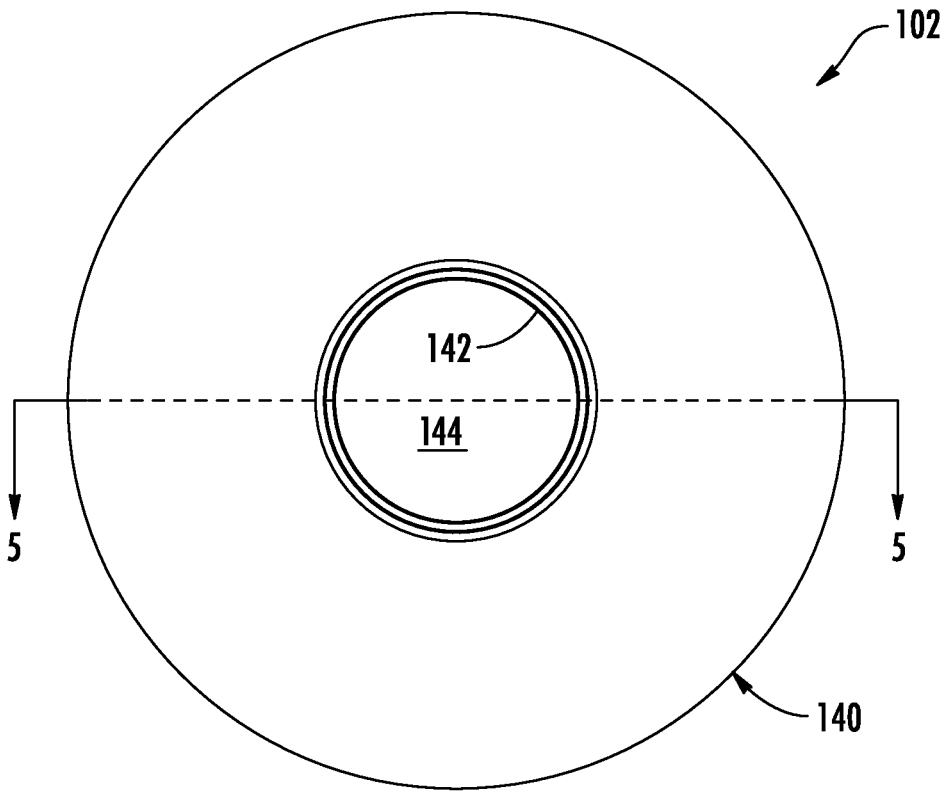
FIG. 4 is a front view of an embodiment of an orifice assembly for controlling airflow of an air passageway of a gas turbine engine according to the present disclosure.

Referring now to FIG. 3, a schematic diagram of an example airflow passageway 100 in a gas turbine engine, such as the engine 10, that can benefit from an orifice assembly 102 for controlling airflow according to the present disclosure is illustrated. For example, as shown, the airflow passageway 100 may be subject to changing conditions, such as high temperature fluctuations, as represented by heat map 105. Thus, in an effort to provide improved cooling, the orifice assembly 102 may be used an inlet 104 or an outlet 106 of the airflow passageway 100 to provide adaptive and passive airflow therethrough. Accordingly, in certain embodiments, it should be understood that the orifice assembly 102 may be arranged at any suitable location in the engine 10, such as at any inlet or outlet of a nozzle, a heat exchanger, a turbine vane, or a stator vane of the gas turbine engine 10, as well as any other suitable location.

Figure 5:
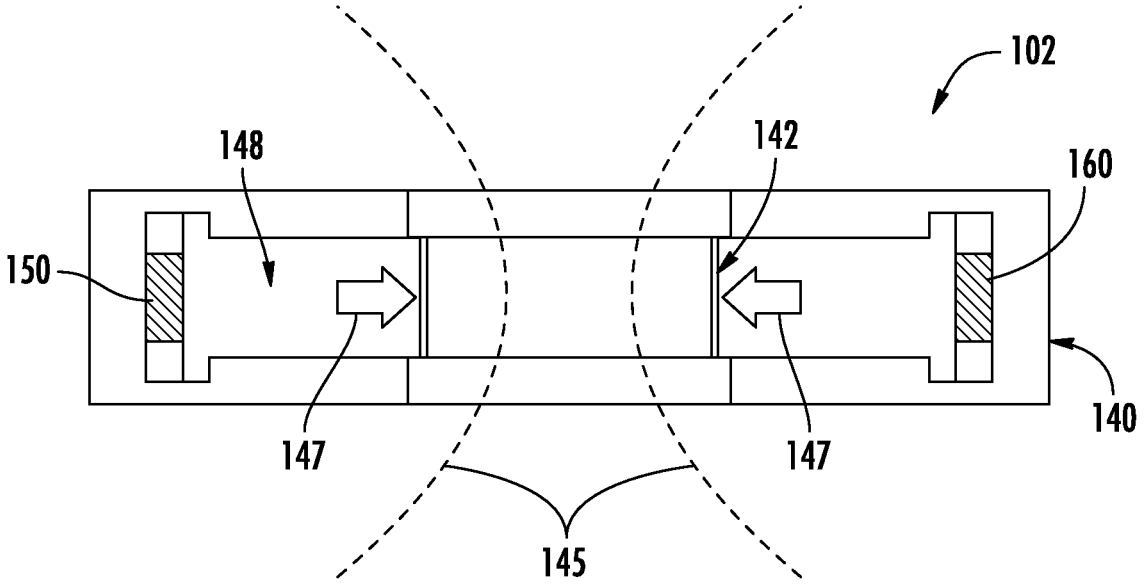
FIG. 5 is a cross sectional view of the orifice assembly of FIG. 4 along line 5-5.
Figure 6:
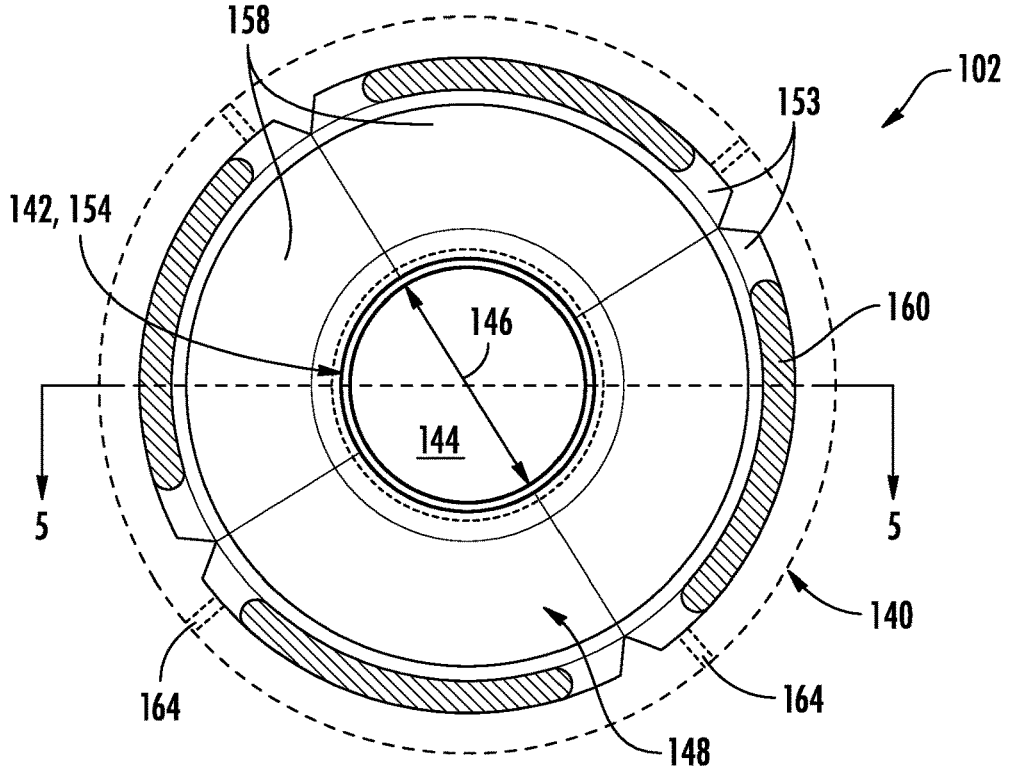
FIG. 6 is a front, internal view of an embodiment of an orifice assembly for controlling airflow of an air passageway of a gas turbine engine according to the present disclosure, particularly illustrating the orifice assembly in a compressed state.
Figure 7:
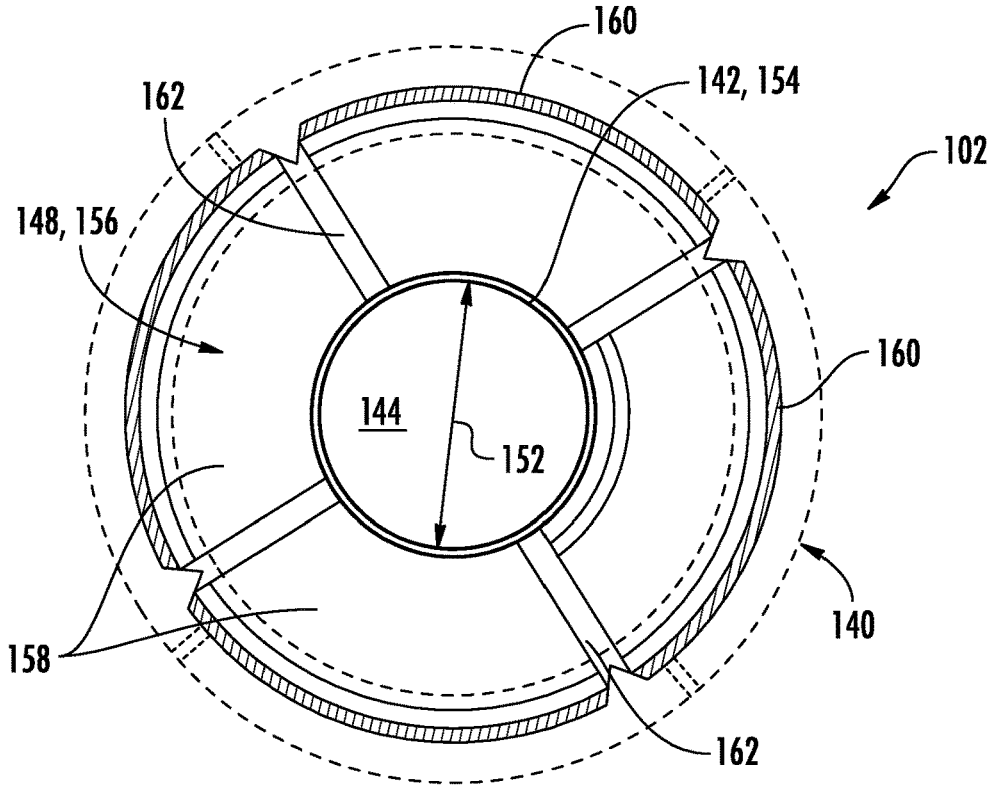
FIG. 7 is a front, internal view of an embodiment of an orifice assembly for controlling airflow of an air passageway of a gas turbine engine according to the present disclosure, particularly illustrating the orifice assembly in a decompressed state.

Referring now to FIGS. 4-7, various views of an embodiment of the orifice assembly 102 according to the present disclosure is illustrated. In particular, as shown generally in FIGS. 4-7, the orifice assembly 102 generally includes a housing 140. Further, as shown, the orifice assembly 102 includes an inner member 142, an outer member 148, and a thermally-sensitive material 160 arranged within the housing 140. In particular embodiments, as shown in FIGS. 6 and 7, the inner member 142 may be an inner ring 154 and the outer member 148 may be an outer ring 156. In such embodiments, as shown, the inner and outer rings 154, 156 may be concentric with each other.

Moreover, as shown, the inner member 142 defines an orifice 144 having a first dimension 146 (FIG. 6) in a compressed state as indicated by the dotted lines in FIG. 5. Further, as shown particularly in FIGS. 5-7, the outer member 148 may be arranged adjacent to and exterior of the inner member 142. In addition, as shown, the thermally-sensitive material 160 may be arranged adjacent to and exterior of the outer member 148. In particular embodiments, for example, as shown in FIG. 6, the thermally-sensitive material 160 may be arranged within one or more gaps 153 between the housing 140 and the outer member 148. Thus, in an embodiment, as shown in FIGS. 5 and 6, the thermally-sensitive material 160 has a rigid, first state that applies force to the inner member 142 (as indicated by arrows 147 in FIG. 5) so as to maintain the first dimension 146 of the orifice 144 in the compressed state (as indicated by arrows 145 in FIG. 5).

Furthermore, in an embodiment, the thermally-sensitive material 160 may be a shape-memory alloy (SMA) or a phase-change material (PCM). As used herein, SMAs generally refer to an alloy that can be deformed when cold but returns to its pre-deformed shape when heated. Example SMAs include copper-aluminum-nickel and nickel-titanium (NiTi), though it should be understood by those of ordinary skill in the art that any SMA may be used in the orifice assembly 102 described herein. Moreover, as used herein, a PCM generally refers to a substance that releases/absorbs sufficient energy at a phase transition to provide useful heat/cooling. Generally, the transition will be from one of the first two fundamental states of matter, i.e., solid and liquid, to the other. The phase transition may also be between non-classical states of matter, such as the conformity of crystals, where the material goes from conforming to one crystalline structure to conforming to another, which may be a higher or lower energy state. The PCMs described herein may include organic PCMs (e.g., paraffin PCMs) and inorganic PCMs (e.g., salt hydrate PCMs), though it should be understood by those of ordinary skill in the art that any PCM may be used in the orifice assembly 102 described herein.

Further, as shown in FIG. 7, the thermally-sensitive material 160 also has a flexible, second state that releases the force applied to the inner member 142. Accordingly, when subjected to temperatures above a predetermined temperature threshold, the thermally-sensitive material 160 changes from the rigid, first state to the flexible, second state to allow the first dimension 146 (FIG. 6) of the inner member 142 in the compressed state to passively expand to a decompressed, second dimension 152 (FIG. 7). Thus, as the second dimension 152 is larger than the first dimension 146, the airflow through the orifice 144 is increased.

In an embodiment, the predetermined temperature threshold described herein may include, for example, temperatures equal to or above 500 degrees Fahrenheit (° F.) (260 degrees Celsius (° C.)), such as between about 500° F. (260° C.) and about 1200° F. (650° C.), or more preferably between about 600° F. (315° C.) and about 1000° F. (540° C.).

Moreover, in an embodiment, as shown in FIG. 7, when the thermally-sensitive material 160 changes from the rigid, first state to the flexible, second state (e.g., the thermally-sensitive material 160 changes from a solid to a liquid due to the increased temperature of the surrounding environment), the inner member 142 pushes against the outer member 148 to compress the thermally-sensitive material 160 to further fill the gap(s) 153 (i.e., to fill any space remaining in the gaps 153) between the housing 140 and the outer member 148. Thus, as shown from FIG. 6 to FIG. 7, as the thermally-sensitive material 160 fills the gap(s) 153, the compressed inner member 142 expands to increase the first dimension 146 to the second dimension 152 such that more cooling air can flow through the orifice 144.

More particularly, as shown in FIGS. 6 and 7, the outer member 148 may be segmented into a plurality of segments 158. In such embodiments, for example, wherein the outer member 148 is an outer ring 156, the plurality of segments 158 may have a generally wedge-shape configuration, similar to pie slices. As such, in an embodiment, when the thermally-sensitive material 160 changes from the rigid, first state to the flexible, second state, the plurality of segments 158 are pushed radially outward (FIG. 7) by expansion of the inner member 142/inner ring 154 as the inner ring 154 decompresses and pushes against the outer ring 156.

Moreover, as shown in FIGS. 6 and 7, the orifice assembly 102 may include one or more pressure and/or mass relief features 162, 164. For example, as shown in FIG. 6, the orifice assembly 102 may include one or more first pressure and/or mass relief features 164 in the housing 140 to allow for air and/or excess material to escape the outer ring 156 during the decompression stage (e.g., from FIG. 6 to FIG. 7). Thus, such features 164 provide a precaution against compressed air and/or excess material preventing full expansion of the inner ring 154 at the trigger temperature. In addition, as shown in FIG. 7, when the plurality of segments 158 are pushed radially outward by the inner ring 154 as the inner ring 154 decompresses and pushes against the outer ring 156, one or more pressure and/or mass relief features 162 (e.g., passageways) extending from the inner ring 154 to an outer edge of the inner ring 154 may also be formed between the plurality of segments 158 to provide pressure and/or mass relief for displaced air and/or excess material after the thermally-sensitive material 160 changes from the rigid, first state to the flexible, second state.

Accordingly, the orifice assembly of the present disclosure is configured to passively control the size of a metering orifice. Thus, the orifice assembly of the present disclosure is an improvement over existing orifices, which are equipped with valves that open and close to accommodate changing conditions of the gas turbine engine or that must be manually replaced with orifices having different, but fixed dimensions to accommodate changing operational conditions. As such, the orifice assembly of the present disclosure is configured to passively accommodate varying airflow conditions through the life of the gas turbine engine.

Further aspects are provided by the subject matter of the following clauses:

Clause 1. An orifice assembly, comprising:

a first member defining an orifice having a first dimension in a compressed state; and a thermally-sensitive material arranged adjacent to the first member, the thermally-sensitive material having a rigid, first state that applies force to the first member so as to maintain the first dimension of the orifice in the compressed state and a flexible, second state configured to release the force applied to the first member, wherein, when subjected to temperatures above a predetermined temperature threshold, the thermally-sensitive material changes from the rigid, first state to the flexible, second state to allow the first dimension of the first member in the compressed state to passively expand to a decompressed, second dimension, the second dimension being larger than the first dimension.

Clause 2. The orifice assembly of clause 1, further comprising a second member, wherein the first member is an inner member and the second member is an outer member, the outer member being arranged adjacent to and exterior of the inner member.

Clause 3. The orifice assembly of any of the preceding clauses, wherein the thermally-sensitive material is arranged adjacent to and exterior of the outer member.

Clause 4. The orifice assembly of any of the preceding clauses, further comprising a housing, wherein the inner member, the outer member, and the thermally-sensitive material are arranged within the housing.

Clause 5. The orifice assembly of any of the preceding clauses, wherein the thermally-sensitive material is arranged within one or more gaps between the housing and the outer member.

Clause 6. The orifice assembly of any of the preceding clauses, wherein, when the thermally-sensitive material changes from the rigid, first state to the flexible, second state, the inner member pushes against the outer member to compress the thermally-sensitive material so as to further fill the one or more gaps between the housing and the outer member.

Clause 7. The orifice assembly of any of the preceding clauses, wherein the inner member is an inner ring and the outer member is an outer ring, the inner and outer rings being concentric with each other.

Clause 8. The orifice assembly of any of the preceding clauses, wherein the outer ring is segmented into a plurality of segments.

Clause 9. The orifice assembly of any of the preceding clauses, wherein, when the thermally-sensitive material changes from the rigid, first state to the flexible, second state, the plurality of segments are pushed radially outward by the inner ring as the inner ring decompresses and pushes against the outer ring.

Clause 10. The orifice assembly of any of the preceding clauses, wherein, when the plurality of segments are pushed radially outward by the inner ring as the inner ring decompresses and pushes against the outer ring, one or more passageways extending from the inner ring to an outer edge of the outer ring are formed between the plurality of segments to provide pressure relief for displaced air after the thermally-sensitive material changes from the rigid, first state to the flexible, second state.

Clause 11. The orifice assembly of any of the preceding clauses, wherein the thermally-sensitive material comprises at least one of a shape-memory alloy or a phase-change material.

Clause 12. The orifice assembly of any of the preceding clauses, wherein the predetermined temperature threshold comprises temperatures equal to or above 500 degrees Fahrenheit.

Clause 13. The orifice assembly of any of the preceding clauses, wherein the turbomachine is a gas turbine engine, and wherein the orifice assembly is arranged at an inlet or an outlet of at least one of a nozzle, a heat exchanger, a turbine vane, or a stator vane of the gas turbine engine.

Clause 14. A gas turbine engine, comprising:

an orifice assembly arranged at an inlet or an outlet in the gas turbine engine, the orifice assembly comprising:

an inner member defining an orifice having a first dimension in a compressed state;

an outer member arranged adjacent to and exterior of the inner member; and a thermally-sensitive material arranged adjacent to and exterior of the outer member, the thermally-sensitive material having a rigid, first state that applies force to the inner member so as to maintain the first dimension of the orifice in the compressed state and a flexible, second state that releases the force applied to the inner member, wherein, when subjected to temperatures above a predetermined temperature threshold, the thermally-sensitive material changes from the rigid, first state to the flexible, second state to allow the first dimension of the inner member in the compressed state to passively expand to a decompressed, second dimension, the second dimension being larger than the first dimension.

Clause 15. The gas turbine engine of clause 14, further comprising a housing, wherein the inner member, the outer member, and the thermally-sensitive material are arranged within the housing.

Clause 16. The gas turbine engine of clauses 14-15, wherein the thermally-sensitive material is arranged within one or more gaps between the housing and the outer member.

Clause 17. The gas turbine engine of clauses 14-16, wherein, when the thermally-sensitive material changes from the rigid, first state to the flexible, second state, the inner member pushes against the outer member to compress the thermally-sensitive material so as to further fill the one or more gaps between the housing and the outer member.

Clause 18. The gas turbine engine of clauses 14-17, wherein the inner member is an inner ring and the outer member is an outer ring, the inner and outer rings being concentric with each other, and wherein the outer ring is segmented into a plurality of segments, wherein, when the thermally-sensitive material changes from the rigid, first state to the flexible, second state, the plurality of segments are pushed radially outward by the inner ring as the inner ring decompresses and pushes against the outer ring.

Clause 19. The gas turbine engine of clauses 14-18, wherein, when the plurality of segments are pushed radially outward by the inner ring as the inner ring decompresses and pushes against the outer ring, one or more passageways extending from the inner ring to an outer edge of the outer ring are formed between the plurality of segments to provide pressure relief for displaced air after the thermally-sensitive material changes from the rigid, first state to the flexible, second state.

Clause 20. The gas turbine engine of clauses 14-19, wherein the thermally-sensitive material comprises at least one of a shape-memory alloy or a phase-change material.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

We claim:

1. An orifice assembly, comprising:

an inner member defining an orifice having a first dimension in a compressed state;

an outer member arranged adjacent to and radially exterior of the inner member; and a thermally-sensitive material arranged adjacent to and radially exterior of the outer member, wherein the thermally-sensitive material has a rigid, first state that applies force to the inner member so as to maintain the first dimension of the orifice in the compressed state and a flexible, second state configured to release the force applied to the inner member, wherein, when subjected to temperatures above a predetermined temperature threshold, the thermally-sensitive material changes from the rigid, first state to the flexible, second state to allow the first dimension of the inner member in the compressed state to passively expand to a decompressed, second dimension, the second dimension being larger than the first dimension.

2. The orifice assembly of claim 1, further comprising a housing, wherein the inner member, the outer member, and the thermally-sensitive material are arranged within the housing.

3. The orifice assembly of claim 2, wherein the thermally-sensitive material is arranged within one or more gaps between an inner wall of the housing and the outer member.

4. The orifice assembly of claim 3, wherein, when the thermally-sensitive material changes from the rigid, first state to the flexible, second state, the inner member pushes against the outer member to compress the thermally-sensitive material against the inner wall of the housing so as to further fill the one or more gaps between the inner wall of the housing and the outer member.

5. The orifice assembly of claim 1, wherein the inner member is an inner ring and the outer member is an outer ring, the inner and outer rings being concentric with each other.

6. The orifice assembly of claim 5, wherein the outer ring is segmented into a plurality of segments.

7. The orifice assembly of claim 6, wherein, when the thermally-sensitive material changes from the rigid, first state to the flexible, second state, the plurality of segments are pushed radially outward by the inner ring as the inner ring decompresses and pushes against the outer ring.

8. The orifice assembly of claim 7, wherein, when the plurality of segments are pushed radially outward by the inner ring as the inner ring decompresses and pushes against the outer ring, one or more passageways extending from the inner ring to an outer edge of the outer ring are formed between the plurality of segments to provide pressure relief for displaced air after the thermally-sensitive material changes from the rigid, first state to the flexible, second state.

9. The orifice assembly of claim 1, wherein the thermally-sensitive material comprises at least one of a shape-memory alloy or a phase-change material.

10. The orifice assembly of claim 1, wherein the predetermined temperature threshold comprises temperatures equal to or above 500 degrees Fahrenheit.

11. The orifice assembly of claim 1, wherein the orifice assembly is arranged at an inlet or an outlet of at least one of a nozzle, a heat exchanger, a turbine vane, or a stator vane of a gas turbine engine.

12. A gas turbine engine, comprising:

an orifice assembly arranged at an inlet or an outlet in the gas turbine engine, the orifice assembly comprising:

an inner member defining an orifice having a first dimension in a compressed state;

an outer member arranged adjacent to and exterior of the inner member; and a thermally-sensitive material arranged adjacent to and exterior of the outer member, the thermally-sensitive material having a rigid, first state that applies force to the inner member so as to maintain the first dimension of the orifice in the compressed state and a flexible, second state that releases the force applied to the inner member, wherein, when subjected to temperatures above a predetermined temperature threshold, the thermally-sensitive material changes from the rigid, first state to the flexible, second state to allow the first dimension of the inner member in the compressed state to passively expand to a decompressed, second dimension, the second dimension being larger than the first dimension.

13. The gas turbine engine of claim 12, further comprising a housing, wherein the inner member, the outer member, and the thermally-sensitive material are arranged within the housing.

14. The gas turbine engine of claim 13, wherein the thermally-sensitive material is arranged within one or more gaps between an inner wall of the housing and the outer member.

15. The gas turbine engine of claim 14, wherein, when the thermally-sensitive material changes from the rigid, first state to the flexible, second state, the inner member pushes against the outer member to compress the thermally-sensitive material against the inner wall of the housing so as to further fill the one or more gaps between the inner wall of the housing and the outer member.

16. The gas turbine engine of claim 12, wherein the inner member is an inner ring and the outer member is an outer ring, the inner and outer rings being concentric with each other, and wherein the outer ring is segmented into a plurality of segments, wherein, when the thermally-sensitive material changes from the rigid, first state to the flexible, second state, the plurality of segments are pushed radially outward by the inner ring as the inner ring decompresses and pushes against the outer ring.

17. The gas turbine engine of claim 16, wherein, when the plurality of segments are pushed radially outward by the inner ring as the inner ring decompresses and pushes against the outer ring, one or more passageways extending from the inner ring to an outer edge of the outer ring are formed between the plurality of segments to provide pressure relief for displaced air after the thermally-sensitive material changes from the rigid, first state to the flexible, second state.

18. The gas turbine engine of claim 12, wherein the thermally-sensitive material comprises at least one of a shape-memory alloy or a phase-change material.

* * * * *